US006209240B1

(12) United States Patent
Engle

(10) Patent No.: US 6,209,240 B1
(45) Date of Patent: Apr. 3, 2001

(54) TEXTILE HOLDING FRAME

(76) Inventor: Rosemary E. Engle, 4951 Toll Bridge Rd., Belton, TX (US) 76513

( * ) Notice: Subject to any disclaimer, the term of this patent is extended or adjusted under 35 U.S.C. 154(b) by 0 days.

(21) Appl. No.: 09/116,433

(22) Filed: Jul. 15, 1998

(51) Int. Cl.[7] ..... D06C 3/08
(52) U.S. Cl. ..... 38/102.91; 38/102.21
(58) Field of Search ..... 38/102.2, 102, 38/102.1, 102.21, 102.4, 102.91; 101/127.1

(56) References Cited

U.S. PATENT DOCUMENTS 807,891 * 12/1905 Weathers ..... 38/102.21
843,269 * 2/1907 Gaines ..... 38/102.21
1,300,724 * 4/1919 Haines ..... 38/102.21
3,482,343 * 12/1969 Hamu ..... 38/102.91
3,950,869 * 4/1976 Samarin ..... 38/102.91
4,658,522 4/1987 Kramer .
4,860,814 * 8/1989 Vilmann et al. ..... 38/102
5,586,400 * 12/1996 Moore, III ..... 38/102.2
5,676,052 * 10/1997 Wegrzyn et al. ..... 38/102.21
5,870,840 * 2/1999 Geils et al. ..... 38/102.21

* cited by examiner

*Primary Examiner*—Ismael Izaguirre

(57) ABSTRACT

A textile or other material holding frame portion having a pair of side members and two or more lateral members extending between the sides to define a generally rectangular configuration. One embodiment uses stationary frame members with retainers for material retention and/or tensioning, and another embodiment uses rotating frame members to provide the desired tensioning. Both embodiments may include pressure joints and/or slip joints, be self-supporting, table supported or utilize a base support.

12 Claims, 5 Drawing Sheets

TEXTILE HOLDING FRAME

BACKGROUND OF THE INVENTION

1. Field of the Invention

This invention relates generally to quilting, needlework and other textile holding frames, and more particularly to improvements in the art of textile holding frames to facilitate the support, retention, and/or tensioning of the textile or other materials for comfortable and efficient use, and the maintenance of proper tension on the textile or other materials to be worked.

2. Description of the Prior Art

Quilting frames and other textile supporting frames have traditionally been constructed from various types of wood, and have frequently included some form of structure for orienting the materials to be worked into a comfortable position for the user. The simplest wooden frames were four lengths of wood arranged in a rectangle, temporarily attached at the corners with metal clamps usually supported on chairs over which was stretched the basted quilt to be worked. These tensioned the quilt adequately, and were inexpensive, but were awkward, essentially immobile, required basting of the quilt "sandwich" before actual quilting, and took up a large amount of space. The more sophisticated wooden frames included three or even four rotating parallel wooden poles with a support for positioning the frame in a comfortable position. The first rotating pole farthest from the quilter held the fabric which would comprise the top surface/side of the quilt; the second rotating pole held a supply of fabric and batting which would comprise the underside and middle batting layer of the quilt; and the third rotating pole received the three layers comprising the finished quilt after the quilting operation had been completed. Structure was provided for applying the necessary tension to each of the rotating poles to tension the quilt "sandwich" ready for quilting, generally a ratchet mechanism. Advantages of the three pole frames are the ability to quilt without first basting the quilting layers together, and retaining the textile totally on the frame members for cleanliness and neatness. Although generally satisfactory, the most sophisticated wooden frames using the two, three or four rotating pole design are often expensive to produce, large, immobile, heavy, and difficult to assemble for use and to disassemble for storage.

Kramer U.S. Pat. No. 4,658,522 discloses a quilting/textile frame that represents an improvement over the prior art wooden frame designs. The '522 patent discloses a generally rectangular frame that is somewhat analogous to a large embroidery hoop in function, and is formed from lightweight but firm tubular plastic material (PVC) held together with plastic pressure connections along with permanently attached connections, and uses crescent shaped clamp members that are snap fitted over the textile and rod member for tensioning the textile. As compared with prior art wooden frames, the device disclosed in the '522 patent is lightweight, easy to store, relatively easy to assemble and disassemble, easy to move, easy to tension the textile through rotation around the smooth stationary frame member, and relatively inexpensive to manufacture. However, the crescent shaped clamp members disclosed in the '522 patent can be difficult to install, and because of the snap fit and lack of a place to grip the clamp can be quite difficult to remove. Because the clamps must be removed and replaced multiple times to change the position of the textile, this is a major deficiency. In addition, the device of the '522 patent does not provide a structure for supporting the frame in a position comfortable and healthy for the user, either in orientation or height. Furthermore, the '522 frame design uses only clamps for tensioning, and does not provide an alternate frame design providing adequate means for tensioning materials for quilting without first basting the quilting layers together before actual quilting, as in the 2, 3, or 4 rotating pole wooden frames.

SUMMARY OF THE INVENTION

The present invention provides a textile holding frame which overcomes the foregoing and other deficiencies noted in the prior art. The inventive apparatus includes a textile holding frame having a pair of side frame members and two or more lateral frame members extending between the sides to define a generally rectangular configuration, all as is well known in the art. The invention includes two basic embodiments, each using an alternate textile tensioning method, along with suggested frame support bases. One embodiment uses stationary frame members with improved retainers for tensioning, and the alternate embodiment uses rotating frame members to provide the desired tensioning and which may be used with the improved retainers for retention of the textile. Both embodiments may be constructed in a wide variety of frame designs and sizes, and utilized with or without additional slip joints for ease of use, ease of assembly and disassembly, and the comfort and health of the needleworker. As used herein, a "slip joint" is a sliding, rotating, and/or pivoting contact between PVC connectors or other cyclindrical components having varying diameters and/or thickness. This feature of a preferred embodiment of the present invention is described in detailed in the final six paragraphs of the Summary of the Invention, infra. Alternative frame designs include small "lap" supported versions, table supported versions for machine sewing, or a variety of larger, floor supported versions.

The first "stationary member frame" embodiment of the invention employs improved retainers for securing the quilt materials, other needlework/textiles, or other materials to the stationary, firm plastic frame members. The retainers are removable clamp members which include one or more extensions or other structural features to allow an improved hand or fingertip hold to assist in the placement and removal of the retainer from the frame, thus overcoming a deficiency of the prior art. Even though similar in shape to prior art clamps, these structural changes significantly improve the ease of placement, positioning and removal of the retainer. The retainers preferably have roughly the cross-sectional shape of the Greek letter "Omega" due to the presence of lip or flange portion(s), which features can be gripped by the user's fingertips and are therefore readily slipped into and out of engagement with the frame member to secure the quilting material or textile to effect both retention and tensioning. One version of the inventive retainer includes directional ridges on the inside surface for greater ability to grip the textile, thus increasing tensioning ability when rotating the retainer around the stationary frame member. The Omega-shaped retainer at least partially encircles the stationary pole (e.g., at least 180 degrees). The preferred stationary member frame embodiment includes a base portion to support the frame in an appropriate position.

The alternate "rotating member frame" embodiment of the invention also has the advantage of a frame made with tubular plastic and pressure joints and retains the advantages of the prior art three pole wooden quilting frames, but without the disadvantages. The three lateral member design allows for a no-baste technique—a significant time saver. In addition, it maintains the entire lengths of textile rolled onto the lateral members for cleanliness and ease of use.

The rotating member frame embodiment may include two, three or four rotatable lateral frame members adapted to selectively rotate relative to stationary side frame members. The rotatable lateral frame members may be supported internally or externally by the stationary side members. Textiles other than quilts can be supported when two rotatable lateral members are used for tensioning. Structure is provided for applying the necessary stability or positioning of each of the rotatable lateral members to tension the textile or quilt "sandwich". The rotatable poles/lateral members may be rotated and held in a selected position by an internal or external ratchet, friction, elastic cords, removable pins or other means. The textile may be held onto the rotating members by the inventive Omega-shaped retainers or alternate means.

Both embodiments of the inventive apparatus preferably include a base portion which supports the rectangular frame portion holding the quilting material or textile in an angular, horizontal or vertical orientation to provide the best posture and comfort for the user. The orientation of the rectangular frame portion (actually holding the quilt or textile) may be fixed between zero and ninety degrees relative to the floor for needle working and the like, or may be fully variable to be able to place the needlework, textile or quilt in the most comfortable position for work. This work includes but is not limited to planning, viewing, basting, quilting, needling, tying and the like, along with storage, or viewing the underside of the quilt or textile. The variable positioning may be achieved by but is not limited to use of a slip joint between the rectangular frame portion and the support base portion, where it easily rotates and is easily separated for disassembly. Angle adjustment may be achieved by but is not limited to variable height adjustment from the legs of the support base portion. The support base may be adjustable in angle and height, such as by the use of telescoping tubular members, spacers, apertures with locking pins, extensions, or other mechanisms. Variations of frame and support base design include but are not limited to those allowing for expansion of size, such as for use with multiple needle workers or alternate uses.

The inventive apparatus may also utilize one or a variety of forms of a "slip joint". The slip joint may be a prominent feature of various frame designs and may be the basis for very easy assembly and disassembly, easy addition of attachments such as a support base or light bar, and rotating pivot points for angle adjustment. A variation of the slip joint provides the alternate tensioning method in the rotating member frame embodiment. The slip joint represents an alternate use of PVC connections which are normally stationary and water tight when cemented, or are stationary pressure/friction joints as has been used in the prior art. The slip joint allows for easy movement whether pivoting/rotational or parallel with the pipe/connector. The slip joint is based on standard PVC pipe and connectors that fit closely inside and slip within one another, as opposed to the stationary pressure joint.

Examples of slip joints include, but are not limited to:

a. Connectors only—a standard 1 inch (2.54 cm) PVC cap fits closely inside and slips/pivots within a standard 1¼ inch (3.18 cm) el or tee, and provides for a pivoting joint between the rectangular frame (lateral and side members) holding the textile and the supporting frame base.

b. Pipes only—a 1 inch (2.54 cm) (any thickness) PVC pipe that fits closely inside 1¼ inch (3.18 cm) schedule 40 PVC pipe can rotate or slide lengthwise.

c. Combination pipes and connectors—a 1 inch (2.54 cm) straight connector and pipe slides easily into and out of a 1¼ inch (3.18 cm) connector and schedule 40 pipe for ease of assembly and disassembly. Various sizes of pipe and types of connectors from ½ inch (1.27 cm) may be used for the slip joint.

For use in the rotating member frame embodiment, a variation of the slip joint may be used. For example, an external 1¼ inch (3.18 cm) schedule 40 PVC pipe (rotating member) upon which the textile is placed, rotates relative to and is supported by an internal stationary 1 inch (2.54 cm) PVC pipe attached to the end member, though other variations or combinations could be used.

DETAILED DESCRIPTION OF A PREFERRED EMBODIMENT

Figure 1:
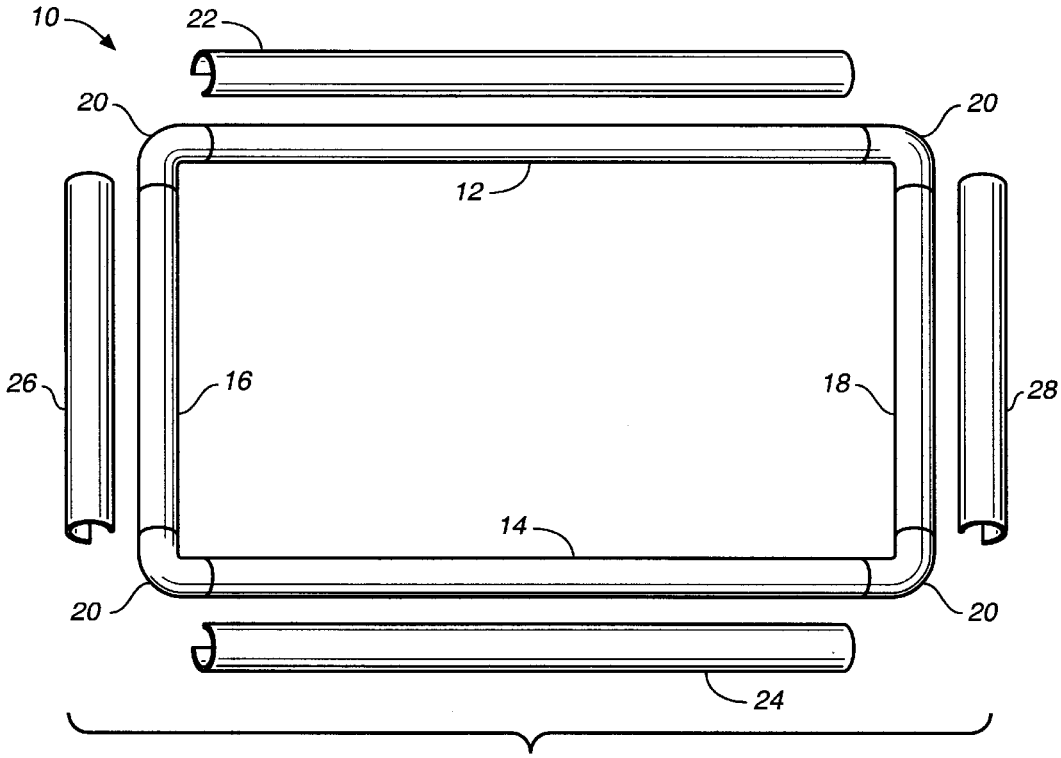
FIG. 1 (PRIOR ART)
FIG. 1 is a top plan view of a prior art quilting/textile frame.

Referring now to the drawings, and particularly to FIG. 1 thereof, there is shown a quilting/textile frame of the type disclosed in Kramer U.S. Pat. No. 4,658,522. The quilting frame 10 comprises lateral members 12 and 14 and side members 16 and 18 all formed from PVC tubing. Four elbows 20 also formed from PVC tubing interconnect the lateral members 12 and 14 and permanently connect the side members 16 and 18 to define a rectangular configuration. Clamping members 22, 24, 26 and 28 function to secure material to be quilted in engagement with the lateral members 12 and 14 and the side members 16 and 18, respectively. The clamping members 22, 24, 26 and 28 comprise lengths of PVC tubing which are slit lengthwise to define a C-shaped cross-sectional configuration. A further understanding of the construction and operation of that quilting frame may be had by reference to U.S. Pat. No. 4,658,522, the disclosure of which is incorporated herein by reference.

Figure 2:
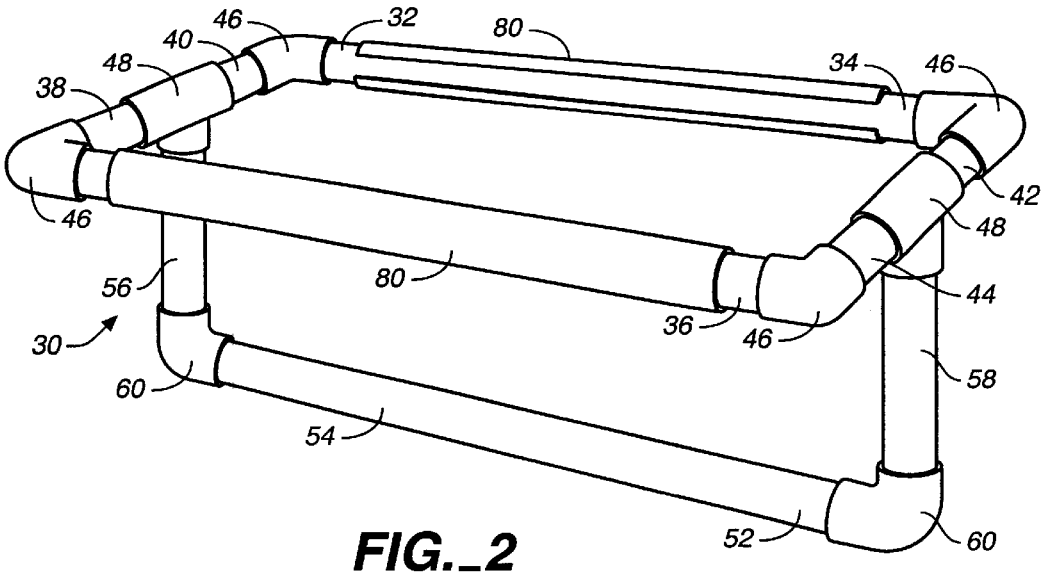
FIG. 2 is a perspective view of a basic lap-sized stationary member frame embodiment of the textile holding frame of the present invention.

Referring now to FIG. 2, there is shown a textile holding frame 30 comprising a first "stationary member frame" embodiment of the present invention. The frame 30 includes an upper textile supporting frame 32 comprising lengths of PVC tubing 34, 36 forming the lateral members, and 38, 40, 42, and 44 forming the side members. Four elbows 46 and two tee's 48, also formed from PVC, interconnect the tubing sections 34, 36, 38, 40, 42 and 44 to define the rectangular fabric supporting frame 32.

The frame 30 further includes base 52 comprising a horizontally disposed length of PVC tubing 54; vertically disposed lengths of PVC tubing 56 and 58, and two elbows 60. The rectangular textile supporting frame 32 is supported on the base 52 by engagement of the vertically disposed tubing sections 56 and 58 with the tee's 48. The base 52 of the frame 30 is adapted for use as a "lap" frame, as when the needle worker is sitting on a couch, chair or bed.

The frame 30 further comprises a plurality of Omega-shaped retainers 80 which function to secure the material being quilted in engagement with the tubing sections 34 and 36.

Figure 3:
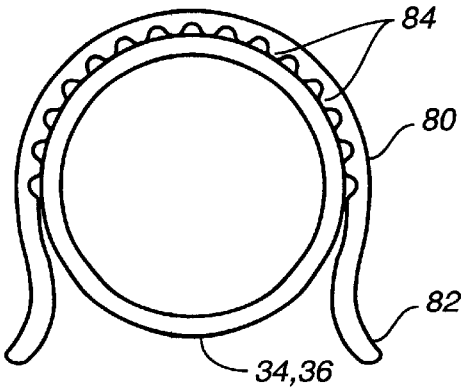
FIGS. 3, 3A, 3B and 3C are side elevation cross-sectional views of retainers used in the invention.

Referring to FIG. 3, the cross-sectional configuration of the retainers 80 takes roughly the form of the Greek letter Omega. Thus, each Omega-shaped retainer 80 has at least one or a pair of radially outwardly extending lips or flanges 82 which facilitate engagement and disengagement of the retainer 80 relative to the tubing sections 34 and 36. Each retainer 80 is preferably further provided with an interior texture or structure, such as a plurality of longitudinally extending ridges 84 disposed around at least some portion of its interior surface, whereby the retaining and tensioning of the material to be quilted in engagement with the tubing section 34 and 36 is facilitated.

Figure 3B:
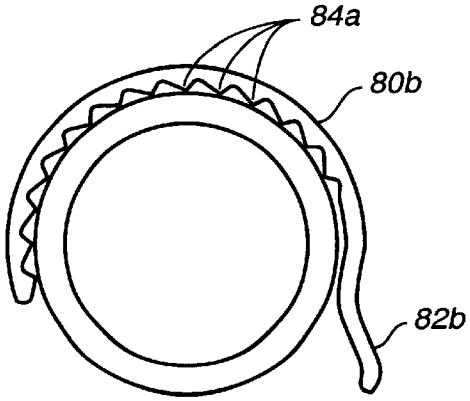
Figure 3A:
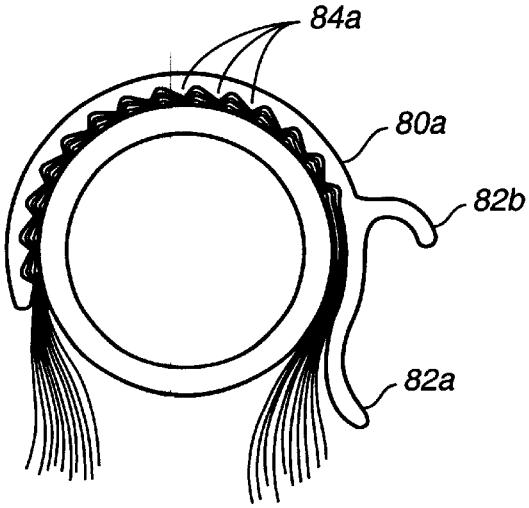
Figure 3C:
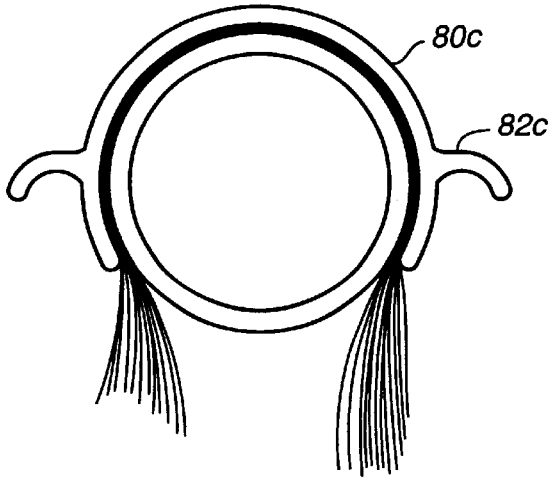

FIG. 3A illustrates an alternate retainer 80*a* bearing a single, terminally-disposed flange 82*a* and a single, medially-disposed flange 82*b* with directional ridges 84*a* disposed around at least some portion of the interior surface. FIG. 3B illustrates an alternate retainer 80*b* bearing a single terminally disposed flange 82*b* with directional ridge 84*a*. FIG. 3C illustrates an alternate retainer 80*c* bearing a pair of medially-disposed flanges 82*c,* and without interior texture or structure.

Figure 4:
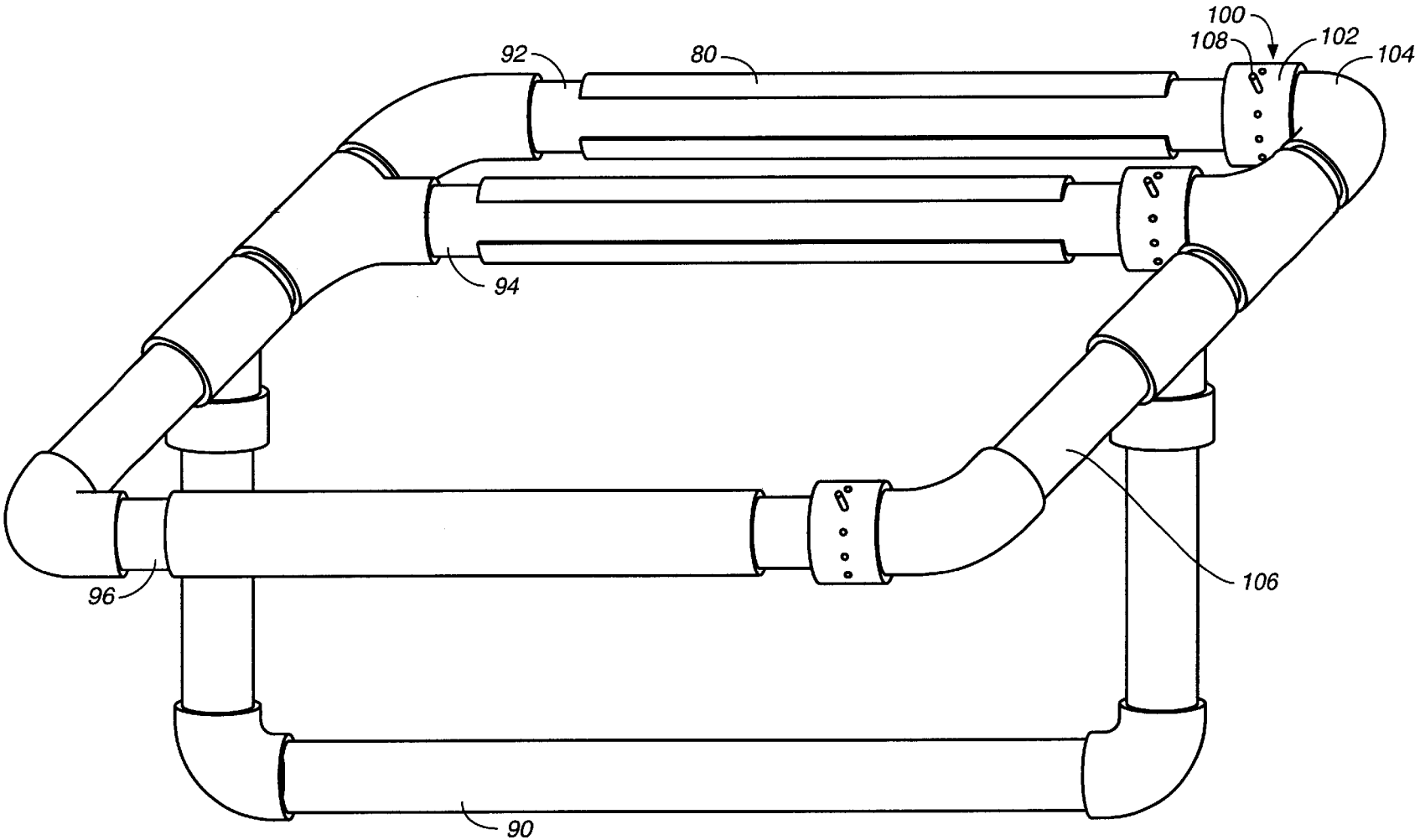
FIG. 4 is a perspective view of a lap-sized three lateral rotating member frame embodiment of the invention.

FIG. 4 illustrates a rotating member frame embodiment 90 of this invention which constitutes a significant variation of the frame 30 illustrated in FIG. 2. The frame 90 is provided with rotatable lateral members or tubing sections 92, 94, and 96, and additional retainers 80. When the frame 90 is employed as a quilting frame, the upper layer of material to be quilted is disposed over the first lateral member (tubing section) 92, the lower layer of material to be quilted and the padding which is to be disposed between the two layers of material to be quilted are disposed over the second lateral member (tubing section) 94, and the completed quilt is disposed over the third lateral member (tubing section) 96. In each instance the material is secured in place by the Omega retainer 80, or alternate retention as by attachment to a cloth apron (not shown).

The rotating members serve to tension and hold lengths of textiles in easily variable positions through rotation to expose unworked sections. The rotatable nature of the lateral members can be accomplished in a variety of ways. For example, the rotating member may utilize a locking pin tensioning arrangement including a collar 100 bearing apertures 102, adapted to be aligned with apertures on sleeves 104 secured to side members 106, and locked in a selected rotational position by insertion of locking pin 108. Alternatively, any other selective rotational positioning method could be employed, including ratchet mechanisms, or even simply high-friction engagement of the respective parts (e.g., collar 100 to sleeve 104).

Figure 5:
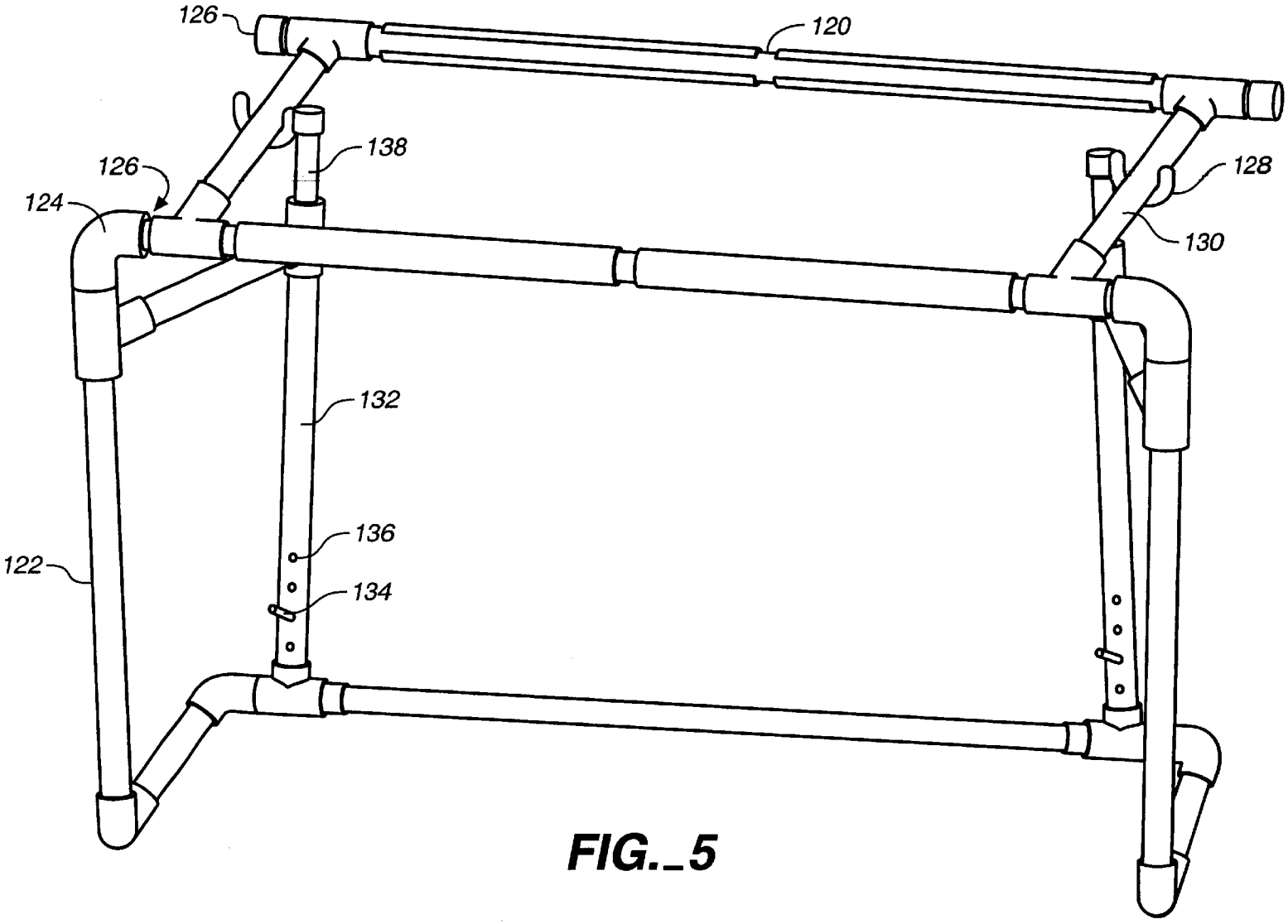
FIG. 5 is a perspective view of a larger stationary member frame, illustrating the extendable legs on the rear of the support base having been raised to place the textile holding frame in an angled position relative to the user.

FIG. 5 is a perspective view of a larger stationary member frame 120 as mounted on a support base 122, and in a angled position illustrating the rear legs 132 of the support base 122 having been raised to place the textile holding frame 120 in an angled position. Legs 132 may be adjusted in height by use of selective placement of locking pins 134 through apertures 136 in legs 132 to support the inner telescoping legs 138 in a raised position. Alternatively, any other height-adjustment mechanism could be used. Support base 122 may include a plurality of vertical and horizontal structural members to provide a stable base and support for a frame, all as described previously. In particular base 122 preferably includes slip joints consisting of a pair of receivers 124 to pivotally engage frame side member extensions 126, and a pair of height-adjustable rests 128 to support frame side members 130.

Figure 6:
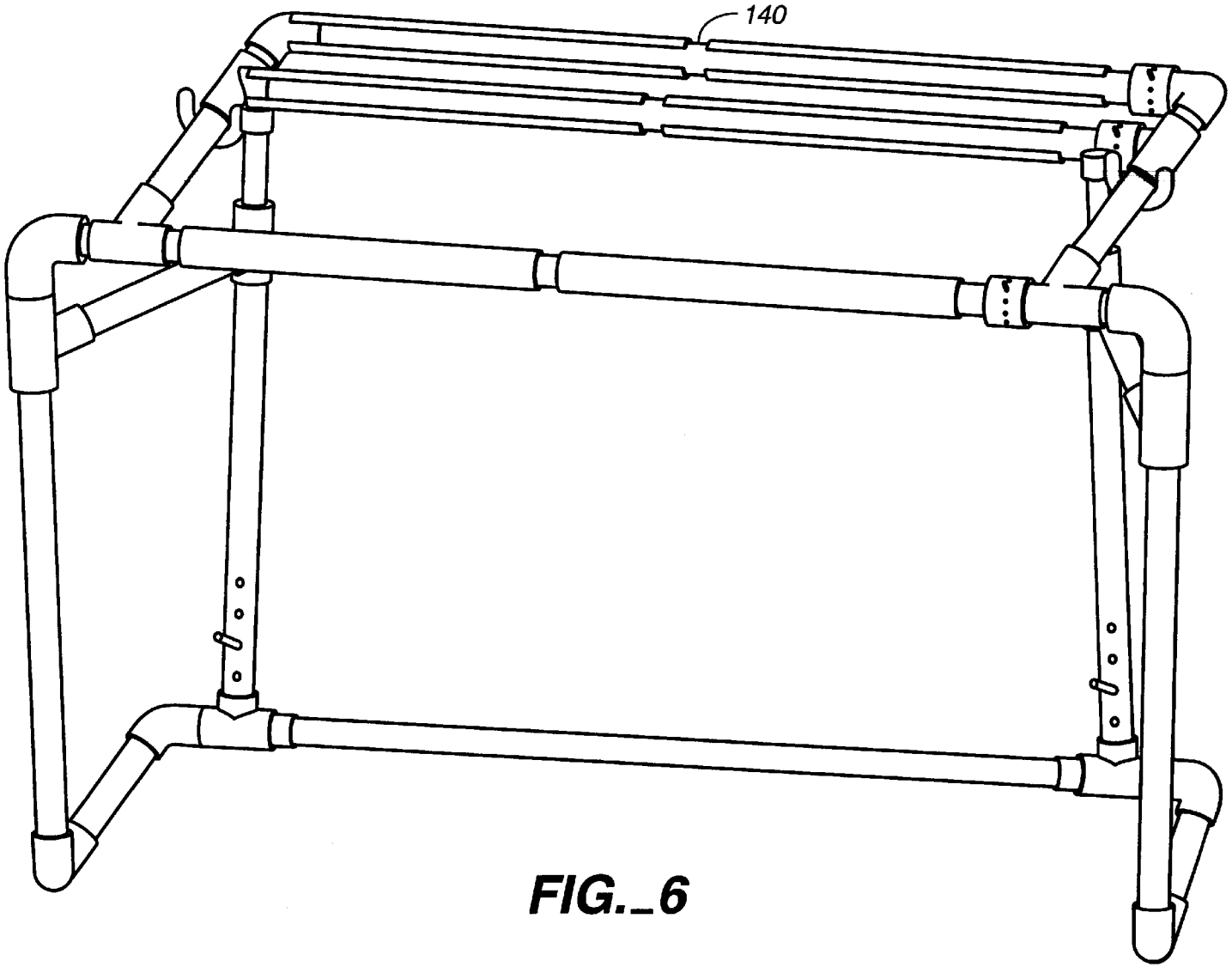
FIG. 6 is a perspective view of a larger rotating member frame as mounted on a support base in an angled position.

FIG. 6 is a perspective view of the larger rotating frame 140 using the same support base as FIG. 5.

While this invention has been described in connection with preferred embodiments thereof, along with two suggested designs for base support portions, it is obvious that modifications and changes therein may be made by those skilled in the art to which it pertains without departing from the spirit and scope of the invention. For example, for the purpose of retention, tensioning, and ease of use, the retainer may be plastic or an alternate material, can have alternate attachments or extensions for the purpose of gripping which may be an integral part of the clamp, attached, or removable, may be plastic, fabric, rope or other material, or may be single or multiple. The retainer may have an alternate internal surface structure, texture, or different material to provide the ability to grip the textile. It is even possible to have a smooth internal surface though this is less effective. The stationary or rotating frame members may also be directionally textured or bear other surface features (as opposed to being smooth) to work in tandem with the retainer. The stationary or rotating frame members can have internal structure for added stiffness. The slip joints could be used in any PVC structure to provide pivoting joints, sliding connections, the feature of assembly and disassembly while maintaining stability, etc. Accordingly, the scope of this invention should be determined not by the embodiment(s) illustrated but is to be limited only by the appended claims and their legal equivalents.

What is claimed as invention is:

1. A textile holding frame for supporting materials, said textile holding frame comprising:

at least two lateral frame members;

a pair of side frame members;

elbow members connecting said lateral frame members to said side frame members to form a generally rectangular frame; and at least two clamp members adapted for releasable engagement with said lateral frame members, wherein said clamp members have a generally C-shaped cross-section including at least one outwardly extending portion to facilitate engagement and disengagement of the clamp members to said lateral frame members, and wherein said clamp members may be fitted over a textile placed on said lateral frame members to grip the textile to the textile holding frame, and wherein said clamp members can be rotated about said lateral frame members to increase or decrease tension of the textile in the textile holding frame, and wherein said clamp members have an inside surface and said inside surface bears a structural feature comprising longitudinal ridges to enhance gripping engagement with a textile.

2. The textile holding frame of claim 1 further including a support base connected to said rectangular frame.

3. The textile holding frame of claim 2 herein said support base is connected to said rectangular frame with slip joints.

4. The textile holding frame of claim 2 wherein said support base includes slip joints.

5. A textile holding frame for supporting material during needlework, said textile holding frame comprising:

at least two substantially cylindrical lateral frame members;

a pair of side frame members;

means for connecting said lateral frame members to said side frame members to form a generally rectangular frame, including means for selectively rotating and stabilizing said lateral frame members relative to said side frame members;

fastening means for securing a textile to said lateral frame members, wherein said lateral frame members may be selectively rotated to increase or decrease tension of the textile in the frame; and slip joints connecting said lateral frame members to said side frame members, said slip joints including means for selectively rotating and stabilizing said lateral frame members relative to said side frame members, and wherein said lateral frame members may be selectively rotated to increase or decrease tension of the textile in the frame.

6. The textile holding frame of claim 5 further including a support base connected to said rectangular frame.

7. The textile holding frame of claim 6 wherein said support base is connected to said rectangular frame with slip joints.

8. A textile holding frame for supporting materials, said textile holding frame comprising:

at least two substantially cylindrical lateral frame members;

at least two side frame members;

elbow members connecting said lateral frame members to said side frame members to form a generally rectangular frame; and at least two clamp members adapted for releasable engagement with said lateral frame members, wherein said clamp members have a generally C-shaped cross-section including at least one outwardly extending portion to facilitate engagement and disengagement of the clamp members to said lateral frame members, wherein said clamp members may be fitted over a textile placed on said lateral frame members to grip the textile to the textile holding frame, and wherein said clamp members can be rotated about said lateral frame members to increase or decrease tension of the textile in the textile holding frame.

9. The textile holding frame of claim 8 wherein said clamp members have an inside surface bearing a structural feature to enhance gripping engagement with a textile.

10. The textile holding frame of claim 9 wherein said structural feature comprises longitudinal ridges.

11. The textile holding frame of claim 8 further including a support base connected to said rectangular frame.

12. The textile holding frame of claim 11 wherein said support base is connected to said rectangular frame with slip joints.

* * * * *